US008806781B2

(12) United States Patent
Sabounjian

(10) Patent No.: US 8,806,781 B2
(45) Date of Patent: Aug. 19, 2014

(54) DEVICE FOR WEARING THONG-TYPE SANDALS

(76) Inventor: Hasmig Sabounjian, La Crescenta, CA (US)

( * ) Notice: Subject to any disclaimer, the term of this patent is extended or adjusted under 35 U.S.C. 154(b) by 910 days.

(21) Appl. No.: 12/539,134

(22) Filed: Aug. 11, 2009

(65) Prior Publication Data

US 2011/0035962 A1 Feb. 17, 2011

(51) Int. Cl.

| | |
|---|---|
| ***A43B 7/26*** | (2006.01) |
| ***A43B 23/00*** | (2006.01) |
| ***A43B 3/10*** | (2006.01) |

(52) U.S. Cl.

CPC ..... *A43B 3/103* (2013.01); *A43B 3/105* (2013.01)

USPC ..... 36/94; 36/11.5; 36/136

(58) Field of Classification Search

CPC ..... A43B 7/26; A43B 3/105; A43B 3/103; A61F 5/019

USPC ..... 36/94, 11.5, 132, 136; 128/893; D2/916; 602/30

See application file for complete search history.

(56) References Cited

U.S. PATENT DOCUMENTS

| | | | | |
|---|---|---|---|---|
| 1,402,375 | A * | 1/1922 | Parisi | 602/30 |
| 4,813,406 | A * | 3/1989 | Ogle, II | 602/22 |
| 5,076,263 | A * | 12/1991 | Funatogawa | 602/30 |
| 5,980,475 | A * | 11/1999 | Gibbons | 602/11 |
| 7,335,178 | B2 | 2/2008 | Berger et al. | |
| 7,980,005 | B1 * | 7/2011 | Young | 36/11.5 |
| 8,117,768 | B2 * | 2/2012 | Bobbett | 36/94 |
| 2002/0121030 | A1 | 9/2002 | Coleman | |
| 2008/0301977 | A1 * | 12/2008 | Roberts et al. | 36/94 |
| 2010/0024247 | A1 * | 2/2010 | Feeney et al. | 36/94 |

OTHER PUBLICATIONS

Tana® Smiling Feet Product Packaging, May 27, 2008.
Picture of Sandal With Tubular Plastic Pre-Mounted During Manufacturing, May 27, 2008.

* cited by examiner

*Primary Examiner* — Jila M Mohandesi
(74) *Attorney, Agent, or Firm* — Milord A. Keshishian

(57) ABSTRACT

A device that engages a stem of a sandal and, in turn, allows the position of toes and web space of a user around the device. The device is constructed to ease the frictional and compression forces on the user by the stem.

23 Claims, 4 Drawing Sheets

DEVICE FOR WEARING THONG-TYPE SANDALS

CROSS-REFERENCE TO RELATED APPLICATIONS

None.

BACKGROUND OF THE INVENTION

1. Field of the Invention

The present invention relates to the field of ergonomics in footwear. More particularly, the present invention relates to the field of devices for engaging a stem of a thong-type sandal and accommodating the webbed region between toes.

2. Background of Related Art

Sandals have existed for numerous years and were one of the earliest forms of footwear. What is simple in its design, i.e. a stem or thong that is engaged between the big and adjacent toe, causes irritation and pain as a result of frictional and compression forces imparted against the toe web-space during a normal gate.

Previous attempts have been made to address the forces imparted by the stem against the web space. For example, U.S. Pat. No. 7,335,178 discloses a protective device for use around the stem. However, the device provides a plantar region that accommodates the bottom of the foot of the user and may cause instability around the point of engagement. Further, the bottom of the foot may become irritated as a result of the variation in height between the region of the device and the platform of the sandal itself.

Accordingly, in light of the current state of the art and the drawbacks to current stem engaging devices mentioned above, a need exists for stem engaging device that would not have a plantar region, would not be subject to twisting around the stem, and would be easy to manufacture and use.

BRIEF SUMMARY OF THE INVENTION

Accordingly, it is a general aspect of the present invention to overcome the disadvantages of the existing devices.

It is another aspect of the invention to provide a cost-efficient stem engaging device.

It is aspect of the invention to provide a stem engaging device that is durable.

It is a further aspect of the invention to provide a stem engaging device that provides for aeration of the toes.

It is still a further aspect of the invention to provide a stem engaging device that can be quickly and easily secured to a stem of a sandal.

In keeping with the principles of the present invention, a unique stem engaging device is disclosed wherein it securely engages the stem of a sandal without requiring a plantar region. The stem engaging device is also shaped to comfortably accommodate the web space between the toes of a wearer.

Such stated aspects and advantages of the invention are only examples and should not be construed as limiting the present invention. These and other aspect, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 2:
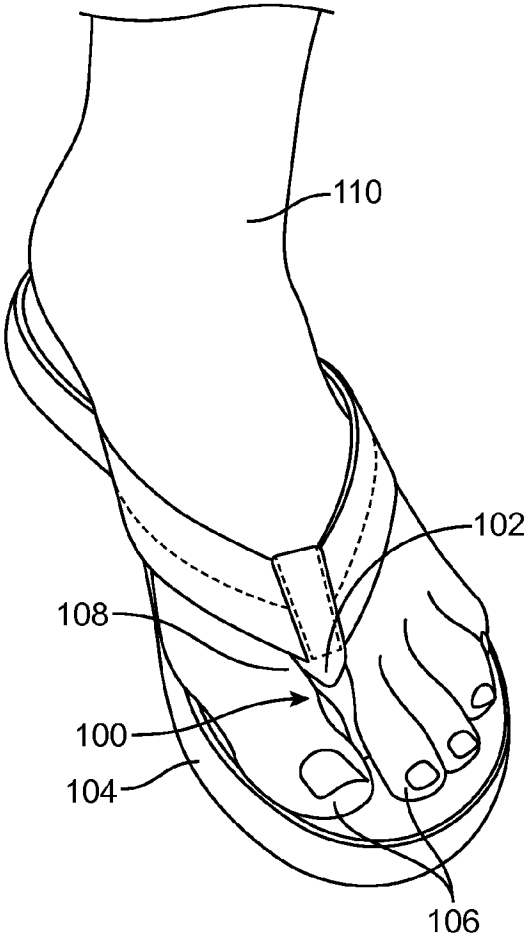
FIG. 2 is an exemplary perspective illustration of the engaging device accommodating a web space between a user's toes.
Figure 1:
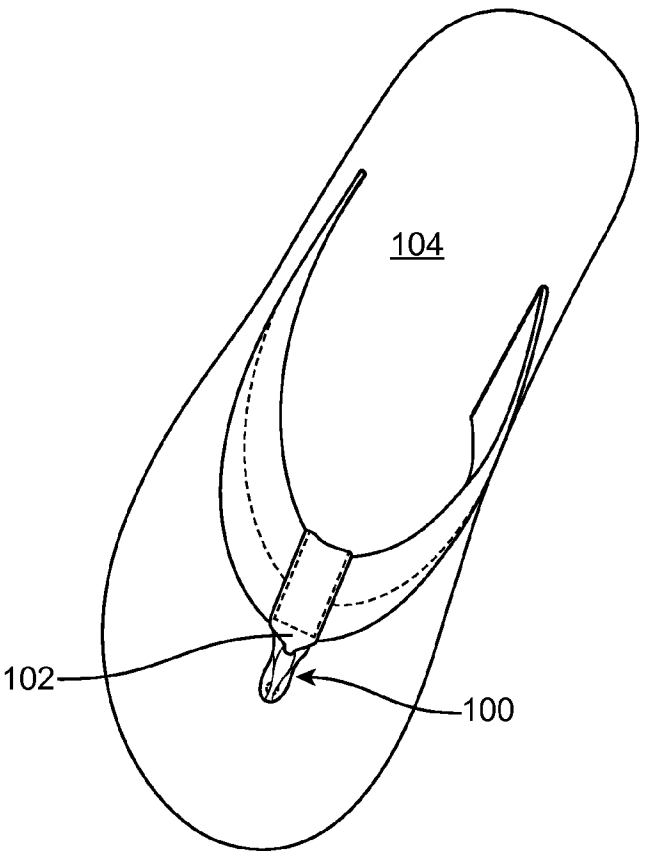
FIG. 1 is an exemplary perspective illustration an engaging device as applied to a stem of a sandal.
Figure 3:
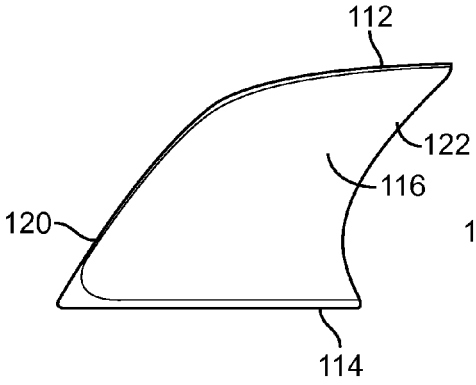
FIG. 3 is an exemplary side elevational view of the device.
Figure 4:
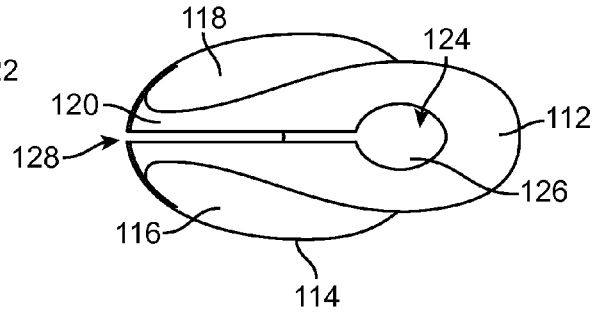
FIG. 4 is an exemplary top perspective view of the device.
Figure 5:
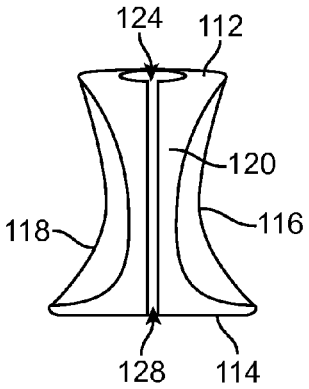
FIG. 5 is an exemplary front side elevational view of the device.
Figure 6:
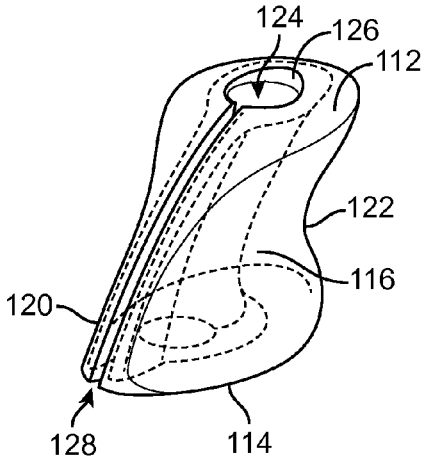
FIG. 6 is an exemplary front side perspective view of the device.

FIGS. 1 and 2 are an exemplary perspective illustration of a preferred embodiment of an engaging device 100 attached to a stem 102 of a sandal 104. As illustrated in FIG. 2, engaging device 100 is maintained between adjacent toes 106 and web space 108 of a user 110.

Referring now to FIGS. 3 to 6, exemplary perspective illustrations of engaging device 100 are provided. Device 100 has a top end 112 and a bottom end 114. A first side 116 and second side 118—being disposed on substantially opposing sides in comparison to one another—are positioned between top 112 and bottom 114 ends. A forward region 120 and a rearward region 122 extend from opposing regions of top 112 and bottom end 114, and said forward 120 and rearward regions 122 also extend between top 112 and bottom 114 ends.

An aperture 124 extends from top end 112 and through bottom end 114 and is defined by an interior wall 126 formed from engaging device 100. Aperture 124 is adapted to accommodate stem 102 therein in a substantially secure manner. A slit 128 is also defined in forward region of device 100 and extends through to and communicates with aperture 124. In order to install device 100 onto stem 102, user 110 pulls first 116 and second 118 sides in opposing directions at slit 128 and stem 102 is passed there-between until it is received by interior wall 126 defining aperture 124. Device 100 is constructed of memory material such that first and second sides 116 and 118 return to their proximally located position and stem 102 is securely maintained within aperture 124.

When user 110 wears sandal 104, adjacent toes 106 and web space 108 are placed around device 100 and it is securely engaged therein. Thus, the enclosure of device 100 between toes 106 and space 108 prevents creeping of the device 100 and eliminates the need for any plantar regions to be engaged by the sole of the foot. To provide for more comfort, in one preferred embodiment of the invention, first and second sides 116 and 118 have a substantially concave outer surface to accommodate adjacent toes 106. Also, in another preferred embodiment, rearward region 122 has a substantially concave outer surface.

Figure 7:
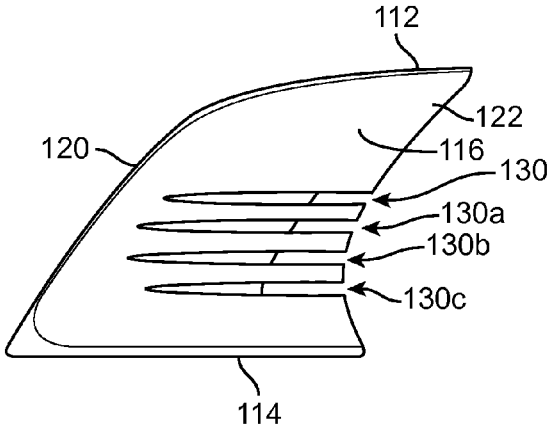
FIG. 7 is an exemplary side elevational view of an alternate preferred embodiment of the device.
Figure 8:
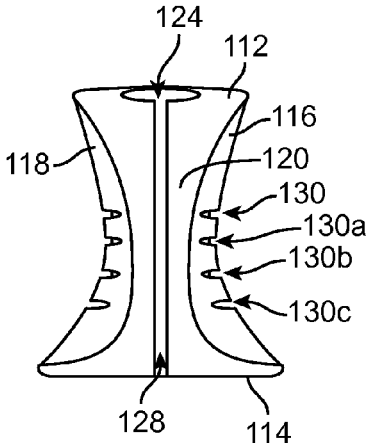
FIG. 8 is a front side elevational view of the alternate preferred embodiment of the device.
Figure 9:
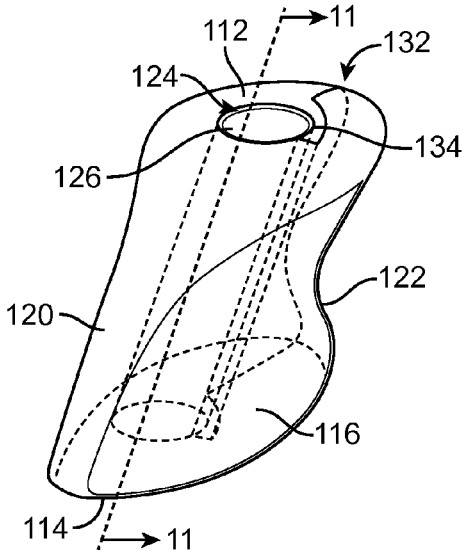
FIG. 9 is a front side perspective view of another alternate preferred embodiment of the device.
Figure 10:
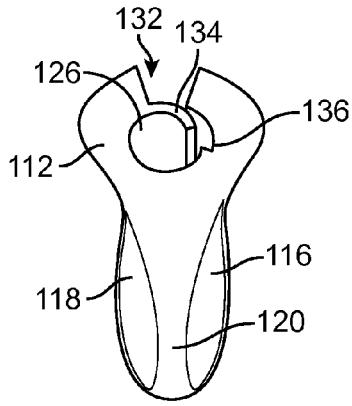
FIG. 10 is a front perspective view of the alternate preferred embodiment illustrating the separation of a closable opening.
Figure 11:
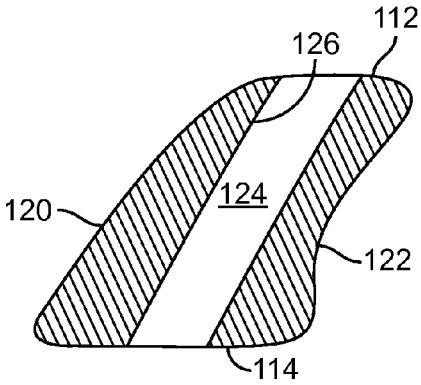
FIG. 11 is a cross sectional view of the other preferred embodiment of the device taken along line 11-11 of FIG. 9.

Now specifically referring to FIGS. 7 and 8, an alternate preferred embodiment of device 100 is presented. At least a groove 130 extends from first side 116 and travels through rearward region 122 and ends at second side 118. Groove 130 is designed to supply oxygen and remove moisture from between toes 106 and web space 108. In order to provide greater aeration and moisture removal, a plurality of grooves 130 to 130*c* may be provided.

Now referring to FIGS. 9 through 14, another alternate preferred embodiment of device 100 is disclosed wherein opening 132 is located along the length of rearward region 122 and allows access to aperture 124 by insertion of stem 102 there through. Opening 132 has a lip 134 that extends and removably attaches to a corresponding mating region 136; wherein, during engagement of device 100 to stem 102, lip 132 spans opening 132 and prevents removal of device 100 while sandal 104 is worn. Lip 134 can be pulled away to allow access to opening 132 and removal of device 100 from stem 102. It is to be understood that although opening 132 is shown to run along the rearward region 122 of the illustrated preferred embodiment, opening 132 may be located anywhere along the wall 126 defining aperture 124 without departing from the essence of the invention. Further, the device 100 may also take a substantially uniform hour glass shape when viewed from the side.

Figure 15:
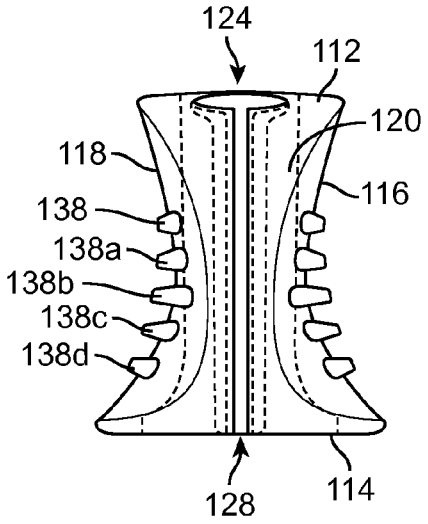
FIG. 15 is a frontal elevational view of yet another preferred embodiment of the device.
Figure 16:
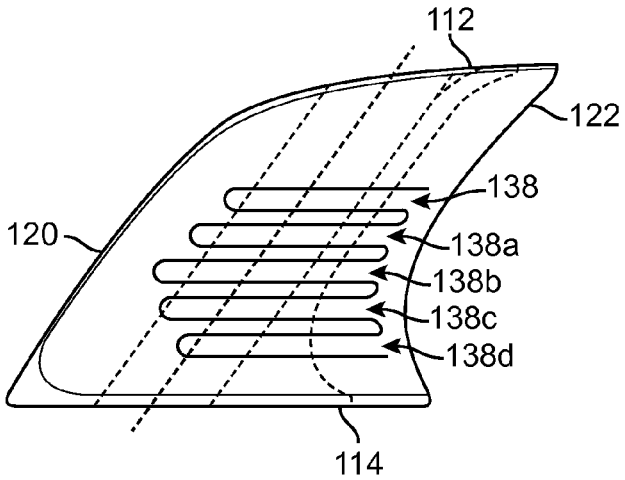
FIG. 16 is a side elevational view of the preferred embodiment of the device.
Figure 17:
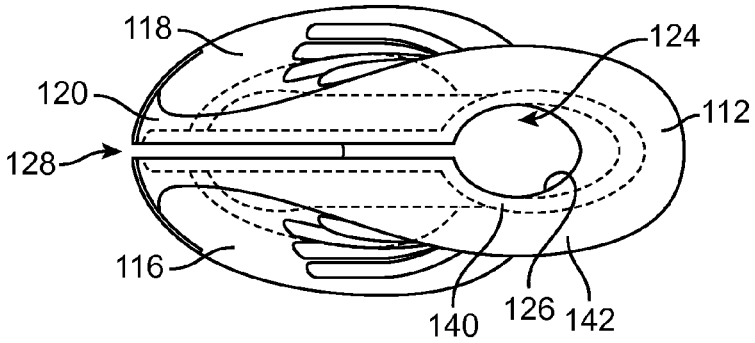
FIG. 17 is a top side perspective view of the preferred embodiment of the device.

Now referring to FIGS. 15 to 17, yet another alternate preferred embodiment of device 100 is disclosed. At least a protrusion 138 extends from first side 116 and travels through rearward region 122 and ends at second side 118. However, protrusion 138 does not necessarily have to extend from first side 116 to second side 118 and each side can have respective protrusions 138 of a shorter length. Protrusion 138 is designed to supply oxygen and remove moisture from between toes 106 and web space 108. In order to provide greater aeration and moisture removal, a plurality of grooves 138 to 138*d* may be provided.

Figure 12:
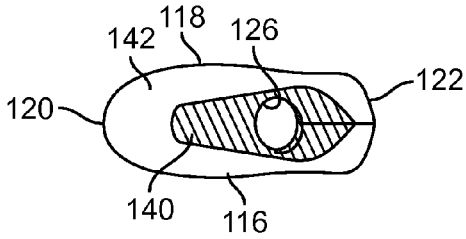
FIG. 12 is a top plant view of the other preferred embodiment of the device.
Figure 13:
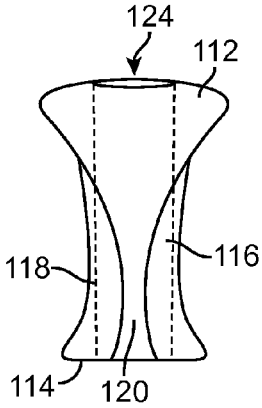
FIG. 13 is a front side elevational view of the other preferred embodiment of the device.
Figure 14:
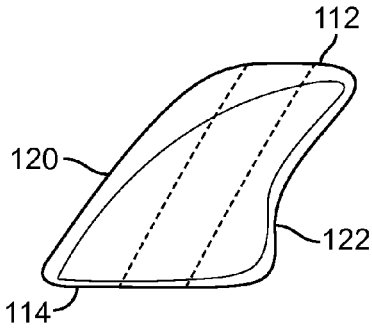
FIG. 14 is a side elevational view of the other preferred embodiment of the device.

In one preferred embodiment, the device 100 of this invention can be manufactured from inert and hypoallergenic materials. The device 100 can be constructed from materials that include, but are not limited to, rubber, thermal plastic rubber ("TPR"), silicone, thermal plastic urethane ("TPU"), polyurethane, and ethyl vinyl acetate. In addition, the material used to manufacture device 100 may have differing durometer readings. Referring specifically to FIG. 12, an inner portion 140 and outer portion 142 run the length of device 100 and are manufactured of silicone. The silicone, however, is of different hardness wherein the outer portion 142 is softer silicone (e.g. hardness 10 silicone) and the inner portion 140 is harder silicone (e.g. hardness 35-40 skeletal silicone). The dual durometer silicone parts allows a more sturdy inner portion 140 to engage the tougher stem 102, yet provides a softer outer portion 142 to comfortable engage the web space 108 of a user.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A device for engaging a stem of a sandal, comprising:

a top end and a bottom end;

an aperture defined by an interior wall extending from said top end and travelling through said bottom end, whereby said stem is retained within said interior wall defining said aperture;

a slit extending between said top and bottom ends and allowing passage of the stem there-through;

a forward region and a rearward region extend from the top end to the bottom end and are interconnected by a first side and a second side;

a rearward region top end extends more rearward than a rearward region bottom end;

a forward region bottom end extends more forwardly than a forward region top end;

a first and a second side bottom ends extend more laterally than a respective first and second side top ends;

at least a first groove runs along a portion of said first side and at least a second groove runs along a portion of said second side;

wherein, said device does not have a plantar based.

2. The device as set forth in claim 1, wherein the device has a substantially hour glass shape.

3. The device as set forth in claim 1, wherein:

the forward region defines said slit and the rearward region accommodates a web space between a user's toes.

4. The device as set forth in claim 3, wherein the rearward region is concaved.

5. The device as set forth in claim 3, wherein the first side and the second side are concaved.

6. The device as set forth in claim 3, wherein at least the first groove runs from said first side, extends around said rearward region, and extends to said second side.

7. The device as set forth in claim 3, wherein a plurality of grooves run from said first side, extend around said rearward region, and extend to said second side and allow aeration and removal of moisture.

8. The device as set forth in claim 1, wherein the device is manufactured from material selected from a group consisting of rubber, thermal plastic rubber ("TPR"), silicone, thermal plastic urethane ("TPU"), polyurethane, and ethyl vinyl acetate.

9. The device as set forth in claim 1, wherein an inner portion surrounds said aperture and an outer portion surrounds said inner portion and said inner portion being of harder material than said outer portion.

10. The device of claim 1, wherein a lip extends across the slit and is received on an opposing mating region and does not allow removal of the stem through said slit while the sandal is worn.

11. A device for engaging a stem of a sandal, comprising:

a top end and a bottom end interconnected by a first side, a second side, a forward region, and a rearward region; wherein the first side, second side, and rearward region are substantially concave;

a forward region bottom end extends more forwardly than a forward region top end;

a plurality of protrusions run from said first side, extend around said rearward region, and extend to said second side and allow aeration and removal of moisture;

an aperture defined by an interior wall extending from said top end and travelling through said bottom end, whereby said stem is retained within said interior wall defining said aperture;

an opening extends between said top and bottom ends and allowing passage of the stem there-through.

12. The device as set forth in claim 11, wherein said device does not have a plantar base.

13. The device as set forth in claim 11, wherein a lip retractably extends across said opening and prevents removal of the stem through said opening while the sandal is worn.

14. The device as set forth in claim 11, wherein the top end of the rearward region extends more rearwardly than the bottom end of the rearward region.

15. A device for engaging a stem of a sandal, comprising:

a top end and a bottom end;

an aperture defined by an interior wall extending from said top end and travelling through said bottom end, whereby said stem is retained within said interior wall defining said aperture;

a slit extending between said top and bottom ends and allowing passage of the stem there-through;

a forward region and a rearward region extend from the top end to the bottom end and are interconnected by a first side and a second side;

a rearward region top end extends more rearward than a rearward region bottom end;

at least a protrusion runs from said first side, extends around said rearward region, and extends to said second side;

wherein, said device does not have a plantar base.

16. The device as set forth in claim 15, wherein a plurality of protrusions run from said first side, extend around said rearward region, and extend to said second side and allow aeration and removal of moisture.

17. A device for engaging a stem of a sandal, comprising:

a top end and a bottom end interconnected by a first side, a second side, a forward region, and a rearward region; wherein the first side, second side, and rearward region are substantially concave;

a forward region bottom end extends more forwardly than a forward region top end;

a plurality of grooves run from said first side, extend around said rearward region, and extend to said second side and allow aeration and removal of moisture;

an aperture defined by an interior wall extending from said top end and travelling through said bottom end, whereby said stem is retained within said interior wall defining said aperture;

an opening extends between said top and bottom ends and allowing passage of the stem there-through.

18. A device for engaging a stem of a sandal, comprising:

a top end and a bottom end;

an aperture defined by an interior wall extending from said top end and travelling through said bottom end, whereby said stem is retained within said interior wall defining said aperture;

a slit extending between said top and bottom ends and allowing passage of the stem there-through;

a forward region and a rearward region extend from the top end to the bottom end and are interconnected by a first side and a second side;

a rearward region top end extends more rearward than a rearward region bottom end;

at least a first groove and at least a first protrusion run along a portion of said first side and at least a second groove and at least a second protrusion run along a portion of said second side;

wherein, said device does not have a plantar base.

19. A device for engaging a stem of a sandal, comprising:

a top end and a bottom end;

an aperture defined by an interior wall extending from said top end and travelling through said bottom end, whereby said stem is retained within said interior wall defining said aperture;

a slit extending between said top and bottom ends and allowing passage of the stem there-through;

a forward region and a rearward region extend from the top end to the bottom end and are interconnected by a first side and a second side;

the rearward region, the first side, and the second side are concaved;

the rearward region extending more rearwardly at a rearward region top end than a rearward region bottom end; and the forward region extending more forwardly at a forward region bottom end than a forward region top end;

a first and a second side bottom ends extending more laterally than a respective first and a second side top ends;

wherein, said device does not have a plantar base.

20. The device for engaging a stem of a sandal as set forth in claim 19, wherein:

at least a groove extends from the first side, extending through the rearward region, and extending at the second side.

21. The device for engaging a stem of a sandal as set forth in claim 19, wherein:

at least a first groove extends partially along the first side and a second groove extends partially along the second side.

22. The device for engaging a stem of a sandal as set forth in claim 19, wherein:

at least a protrusion extends from the first side, extending through the rearward region, and extending at the second side.

23. The device for engaging a stem of a sandal as set forth in claim 19, wherein:

at least a first protrusion extends partially along the first side and a second protrusion extends partially along the second side.

* * * * *